US007112259B2

(12) United States Patent
Cornbower

(10) Patent No.: US 7,112,259 B2
(45) Date of Patent: Sep. 26, 2006

(54) HIGH TEMPERATURE PAPER

(75) Inventor: Tyrone Cornbower, Whitehall, PA (US)

(73) Assignee: FiberMark, Inc., Brattleboro, VT (US)

( * ) Notice: Subject to any disclaimer, the term of this patent is extended or adjusted under 35 U.S.C. 154(b) by 142 days.

(21) Appl. No.: 10/370,615

(22) Filed: Feb. 24, 2003

(65) Prior Publication Data

US 2003/0192663 A1 Oct. 16, 2003

Related U.S. Application Data

(63) Continuation of application No. 10/118,921, filed on Apr. 10, 2002, now Pat. No. 6,537,424.

(51) Int. Cl.

| | |
|---|---|
| ***D21H 27/12*** | (2006.01) |
| ***D21H 27/38*** | (2006.01) |
| ***D21H 13/26*** | (2006.01) |
| ***D21H 17/36*** | (2006.01) |
| ***B32B 5/26*** | (2006.01) |
| ***B32B 29/02*** | (2006.01) |

(52) U.S. Cl. ..... 162/129; 162/123; 162/132; 162/146; 162/157.3; 162/164.1; 156/181; 156/182; 428/479.6; 428/573.5; 442/412; 442/416

(58) Field of Classification Search ..... 162/123–133, 162/146, 157.2, 157.3, 158, 164.1, 168.1, 162/175, 183–185, 302, 304, 148; 428/153, 428/154, 479.3, 479.6, 573.5; 442/412, 414–416; 156/180–182; 174/254, 258
See application file for complete search history.

(56) References Cited

U.S. PATENT DOCUMENTS

| | | | | |
|---|---|---|---|---|
| 2,881,072 | A * | 4/1959 | Clark | 162/132 |
| 3,573,158 | A * | 3/1971 | Pall et al. | 162/146 |
| 3,681,193 | A * | 8/1972 | Nykopp | 162/304 |
| 3,756,908 | A * | 9/1973 | Gross | 162/157.3 |
| 4,267,016 | A * | 5/1981 | Okazaki et al. | 162/146 |
| 4,496,583 | A * | 1/1985 | Yamamoto et al. | 162/157.3 |
| 4,865,691 | A * | 9/1989 | White | 162/168.1 |
| 5,047,469 | A * | 9/1991 | Kitamura et al. | 525/56 |
| 5,166,263 | A * | 11/1992 | Ohgi et al. | 525/56 |
| 5,208,104 | A * | 5/1993 | Ueda et al. | 428/364 |
| 5,498,314 | A * | 3/1996 | Kinsley, Jr. | 162/158 |
| 6,544,622 | B1 * | 4/2003 | Nomoto | 428/116 |

OTHER PUBLICATIONS

Search Report issued in International Application No. PCT/US02/38171, Jun. 2, 2003.

* cited by examiner

*Primary Examiner*—Eric Hug
(74) *Attorney, Agent, or Firm*—Buchanan Ingersoll & Rooney PC

(57) ABSTRACT

Provided is a paper structure comprised of two outside layers and at least one inside layer. The two outside layers are comprised of substantially cellulosic pulp fiber, and the inside layer is comprised of a high temperature fiber and a polymeric binder, and preferably cellulosic pulp fiber. In a preferred embodiment, the structure comprises at least three inside layers, all comprised of cellulosic pulp fiber, high temperature fiber and a polymeric binder. The resulting paper structure finds particular use as a high temperature transformer paper in the manufacture of transformers.

7 Claims, No Drawings

HIGH TEMPERATURE PAPER

This application is a continuation of Application Ser. No. 10/118,921, now U.S. Pat. No. 6,537,424, filed on Apr. 10, 2002.

BACKGROUND OF THE INVENTION

1. Field of the Invention

Provided is a high temperature paper structure comprised of two outside layers and at least one inside layer. The two outside layers are generally comprised of substantially cellulosic pulp fiber, and the inside layer is comprised of cellulosic pulp fiber, a high temperature fiber and a polymeric binder. The paper structure can be used as a high temperature E-board for application in transformers, and offers enhanced thermal resistance.

2. Description of Related Art

High temperature E-board is used in transformers and performs two functions. First, the E-board provides electrical insulation. This keeps the coils in the transformer from short circuiting. Secondly, the board provides mechanical strength. When there is a large passage of current through the transformer, there is force on the layers of the coil to move the board, which is glued to the coils. The glueing of the board to the coil keeps the various coils from telescoping. Each coil acts like a solenoid and tries to move. It is the E-board which prevents this telescoping.

Improving the mechanical strength of the E-board would aid in avoiding problems with telescoping coils. Having a reinforced E-board to strengthen the paper would help to provide the necessary mechanical strength. The paper, however, would have to be made in an efficient and effective manner.

There is also interest in increasing the temperature resistance of E-board for use in transformers so that a less expensive transformer could be designed. By reducing the diameters of the wires in a transformer, the coils would become smaller. Smaller coils require smaller cores and smaller metal containers. Smaller containers hold less oil, and this means that less copper for the wire, steel for the cores and oil for the insulation are needed. Because of the thinner wire, however, the transformer would have more electrical resistance and would run hotter. Thus, the E-board would have to exhibit enhanced thermal resistance before such a transformer would be practical.

A paper which exhibits such enhanced thermal resistance, as well as enhanced mechanical strength would allow the industry to design transformers which can recognize the economic benefits and performance benefits discussed above.

Accordingly, it is an object of the present invention to provide a paper structure which exhibits enhanced thermal resistance.

Yet another object of the present invention is to provide a paper structure which exhibits enhanced mechanical strength.

These and other objects of the present invention will become apparent to the skilled artisan upon a review of the following description, and the claims appended hereto.

SUMMARY OF THE INVENTION

In accordance with the foregoing objectives, provided is a paper structure comprised of two outside layers and at least one inside layer. The two outside layers are preferably comprised of substantially cellulosic (wood) pulp fiber. The inside layer is comprised of cellulosic pulp fiber, a high temperature fiber and a polymeric binder. In a preferred embodiment, the structure comprises at least three inside layers, all comprised of cellulosic pulp fiber, high temperature fiber and a polymeric binder. The most preferred polymeric binder is polyvinyl alcohol.

The present invention also provides a process for making the paper structure of the present invention. A cylinder machine, as is known in the art, is employed with at least three different cylinders. A stock composition comprised substantially of cellulosic pulp fiber is fed to the cylinders corresponding to the outer layers, and a stock solution comprised of the cellulosic pulp fiber, high temperature fiber and a polymeric binder is fed to the other cylinder which corresponds to the inner layer of the paper structure.

The resulting paper structure provides a paper quite useful as E-board in transformers due to its enhanced thermal resistance. Moreover, the high temperature fiber also helps to reinforce the paper to avoid the problems in telescoping coils. The process used to prepare the paper also permits one to efficiently and effectively prepare the paper structure while avoiding problems with sticking due to the presence of the polyvinyl alcohol binder.

DETAILED DESCRIPTION OF THE PREFERRED EMBODIMENTS

The paper structure of the present invention is quite useful as a high temperature E-board. The paper exhibits enhanced thermal resistance as well as good mechanical strength. The good thermal resistance would allow the use of the paper in a transformer with coils of smaller size as it would allow the coils to run hotter. Furthermore, the paper is also reinforced so that when glued to the coils, it would keep the various coils from telescoping. In actual use in a transformer, the paper is coated with an adhesive, such as an epoxy adhesive, and heat bonded to the wire coil surface. It is this bonding to the coils that permits the board to keep the various coils from telescoping. The mechanical strength of the paper structure of the present invention, including its high temperature reinforced fiber in combination with the polymeric binder, permits the E-board to act efficiently and effectively with regard to preventing the coils from telescoping.

The paper structure of the present invention generally comprises two outside layers, and at least one inside layer. The two outside layers are comprised of substantially wood pulp fiber, but can contain a minor amount of synthetic fiber. Such synthetic fiber can be, for example, polyester or nylon fiber. By minor amount, is meant less than 50 wt % fiber, and preferably less than 10 wt percent fiber. It is most preferred that the cellulosic (wood) pulp fiber used is a Kraft fiber.

The inside layer generally comprises cellulosic (wood) pulp fiber, high temperature fiber and a polymeric binder. The high temperature fiber is generally a fiber that has a $T_g$ of at least 400° C., and most preferably higher than 550° C. Preferred high temperature fibers include the polyaramide fibers available commercially, such as NOMEX®. Generally, the fiber is about ¼ inch in length, and has about a 2 denier.

The preferred polymeric binder is polyvinyl alcohol. It can be added in the form of a synthetic fiber or as a dry powder. If the binder is added as a fiber, it is important that the fiber has the proper chemical characteristics. Polyvinyl alcohol fiber is available with a wide range of water solublization temperatures. The temperature at which the polymer becomes soluble depends on the properties of the polymer like the degree of polymerization, degree of hydrolysis, and crystallinity. This solublization temperature can range from about 60° C. to over 100° C. It is important to match this solublization temperature to the paper making process. To be most effective the polyvinyl alcohol fiber should behave as a binder while it is in the fiber form. It should not be allowed to fully dissolve. The strongest binding occurs when the surface of the fiber just starts to dissolve. Then upon drying, the polyvinyl alcohol fiber will bond to all of the other fibers, both synthetic and natural, that it contacts.

This means that a polyvinyl alcohol fiber with a low solublization temperature should be used with a low to medium basis weight paper (roughly 25 to 120 pounds per 3000 square feet) that is typically run at high machine speeds. Because of the higher machine speed and low sheet mass, evaporation will cool the paper. It will dry before it gets very hot. The maximum temperature that the paper will reach is likely to be less than 70° C.

With high basis weight papers (200 pounds per 3000 square feet and above) a polyvinyl alcohol fiber with a higher solublization temperature can be used. These papers are typically run at slower machine speeds so that the sheet temperature is much higher.

When the powder form of the polyvinyl alcohol binder is used, the polymer should be fully hydrolyzed (99% or higher) and the polymer should be ground to a particle size of 100 mesh or smaller. The powder can be added to the wood fiber prior to refining or it can be added to the system after refining. It is important that the powdered polymer be allowed to swell after it is added to the paper making system. Swelling time depends on the water temperature. Cold water (0–14° C.) requires a swelling period of about one hour. Warm water (40–50° C.) will swell the particles in about 20 minutes. It is essential that the process water used with either polyvinyl alcohol fibers or powder not be over 60° C., as hot water will dissolve the polymer and most of the bonding characteristics will be lost.

It is advantageous to use a steam shower with the powder form of the polyvinyl alcohol binder. This shower should hit the paper prior to the dryer section. The steam shower is particularly useful with low basis weight papers. It will heat the sheet while it is still wet thus allowing the outside of the swollen polymer particles to begin to dissolve.

The use of the cellulosic pulp fiber, high temperature fiber and polymeric binder in relative weight ratios for the inside layer is preferably about 70:10:20, respectively. The amount of wood pulp fiber generally ranges from 60 to 80 wt %, the amount of high temperature fiber preferably ranges from 5 to 15 wt %, and the amount of polymeric binder or polyvinyl alcohol generally ranges from 10 to 25 wt %.

In the process of the present invention for making the paper structure, a cylinder machine, as is well known in the art, is employed. The cylinder machine allows for the creation of different layers using different stock compositions, and thus allowing the paper structure to be tailored as needed within the present invention.

The process of the present invention comprises feeding a stock composition comprised substantially of wood pulp fiber to the cylinders corresponding to the outer layers. Thus, the two outside layers of the resulting paper structure comprises substantially cellulosic, preferably wood, pulp fibers. As noted previously, a minor amount of synthetic fibers can be included in the stock compositions.

A cylinder corresponding to the inner layer is then fed with a stock solution comprised of cellulosic pulp fiber, high temperature fiber and a polymeric binder, such that the inner layer of the paper structure is comprised of the cellulosic pulp fiber, high temperature fiber and polymeric binder. Thus, the paper structure of the present invention is such that only the inner layer contains the polymeric binder, whereas the outside layers do not, and thus sticking problems are avoided when the paper structure is dried, preferably on drier cans, and the polymeric binder is activated due to the high temperature. Upon activation of the polymeric binder, the binder acts to bind the high temperature fiber together with the wood pulp fiber, and since it is on the inside layer it will not cause sticking problems.

It is also preferred that the paper structure be coated with a thermal retardant, for example, at the size press. More preferably, the paper structure is coated with a solution of dicyanamide, which compound helps retard the thermal degradation that occurs in a transformer.

In a preferred embodiment, the paper structure is comprised of five different layers. The two outside layers are comprised substantially of cellulosic, preferably wood, pulp fiber. The three internal layers are all comprised of cellulosic pulp fiber, high temperature fiber and a polymeric binder. Optionally, the internal layers can be of different compositions. For example, they can contain different relative amounts of the cellulosic pulp fiber, high temperature fiber and polymeric binder, since different stocks compositions can be fed to the various corresponding cylinders. As well, it may be desired to have only one layer which contains the high temperature fiber and the polymeric binder. The remaining layers would then be comprised primarily of cellulosic pulp fibers.

In another embodiment, the paper structure comprises the two outer layers comprised substantially of cellulosic pulp fiber, and the inner layer is comprised of the high temperature fiber and polymeric binder. The presence of the high temperature fiber and polymeric binder together is important, in at least one inner layer of the paper structure. The remaining layers may differ in composition, as long as the two outside layers do not contain the polymeric binder.

The resulting paper structure, prepared most efficiently and effectively using the cylinder machine in accordance with the present invention, provides one with a paper quite useful as a high temperature paper for transformers. The paper exhibits enhanced thermal resistance, as well as excellent mechanical strength to perform all of the necessary functions of a transformer E-board.

EXAMPLE

A three ply paper structure in accordance with the present invention was prepared. The cylinder machine was used where separate stocks were employed for the outside layers and the inside layer.

The outside layers were fed a furnish comprised of cellulosic pulp. The furnish for the inside layer comprised 70% by weight of a cellulosic pulp, 20% by weight of a polymeric binder, i.e., polyvinyl alcohol, and 10% by weight of a polyaramide fiber. The polymeric binder was comprised of Celvol 165 SF polyvinyl alcohol, and the high temperature fiber was NOMEX® fiber, one-quarter inch in length and 2.0 denier.

Once the furnish for the outside layers and the inside layer had been provided to each of the respective cylinders, a three ply paper structure was prepared. The outer layers were comprised of solely cellulosic pulp, and the inside layer was comprised of the cellulosic pulp in combination with the high temperature fiber and the polymeric binder. The resulting paper structure was then pressed, dried and calendared in conventional fashion. The drying was conducted at a temperature sufficient to activate the polyvinyl alcohol polymeric binder.

The resulting paper structure exhibited good strength properties, and is believed useful as electrical insulation in transformer coils.

Having now fully described the invention, it will be apparent to one of ordinary skill in the art of any changes and modifications that can be made thereto without departing from the spirit and the scope of the invention as set forth.

What is claimed is:

1. A paper structure comprised of two outside layers and at least one inside layer, with the two outside layers consisting essentially of cellulosic pulp fiber, and being free of a polyvinyl alcohol binder, and the said at least one inside layer being formed from an admixture consisting essentially of polyaramide fibers and a polyvinyl alcohol binder in fiber or powder form, the fiber having a water solubilization temperature of at least 60° C., the powder being fully hydrolyzed and having a particle size of 100 mesh or smaller.

2. The paper structure of claim 1, wherein the outer layers contain a minor amount of synthetic fibers.

3. A process for making the paper structure of claim 1, which comprises utilizing a cylinder machine with at least three different cylinders, the process comprising feeding a stock composition consisting essentially of cellulosic pulp fiber and being free of polyvinyl alcohol binder to the cylinders corresponding to the outer layers, such that the two outside layers of the resulting paper structure are substantially cellulosic pulp fibers, and with the other cylinder being fed a stock solution consisting essentially of polyaramide fibers and a polyvinyl alcohol binder, such that the inner layer of the paper structure consists essentially of the polyaramide fiber and the polyvinyl alcohol binder, wherein the polyvinyl alcohol binder is added in the form of a fiber having a water solubilization temperature of at least 60° C. or as a powder.

4. The process of claim 3, wherein the polyvinyl alcohol binder is added as a fully hydrolyzed powder having a particle size of 100 mesh or smaller.

5. The process of claim 3, wherein the polyvinyl alcohol binder is added in the form of a fiber.

6. The process of claim 3, wherein the stock solution fed to the outer layer cylinders contains a minor amount of synthetic fibers.

7. A high temperature transformer paper composed of the paper structure of claim 1.

* * * * *